US007270919B2

(12) United States Patent
Stubbs

(10) Patent No.: US 7,270,919 B2
(45) Date of Patent: Sep. 18, 2007

(54) USE OF TRANSITION METAL COMPOUNDS IN IMAGEABLE COATINGS

(75) Inventor: Brian Stubbs, Nottingham (GB)

(73) Assignee: Datalase Ltd., Cheshire (GB)

( * ) Notice: Subject to any disclaimer, the term of this patent is extended or adjusted under 35 U.S.C. 154(b) by 0 days.

(21) Appl. No.: 10/533,526

(22) PCT Filed: Nov. 12, 2003

(86) PCT No.: PCT/GB03/04894

§ 371 (c)(1),
(2), (4) Date: Aug. 22, 2005

(87) PCT Pub. No.: WO2004/043704

PCT Pub. Date: May 27, 2004

(65) Prior Publication Data

US 2006/0040217 A1 Feb. 23, 2006

(30) Foreign Application Priority Data

Nov. 12, 2002 (GB) ..... 0226383.8
Jul. 30, 2003 (GB) ..... 0317860.5

(51) Int. Cl.
*G06C 1/735* (2006.01)
*G06C 5/16* (2006.01)

(52) U.S. Cl. ..... 430/17; 430/341; 430/346; 430/495.1; 430/616; 430/964

(58) Field of Classification Search ..... 430/341, 430/346, 616, 495.1, 964, 17
See application file for complete search history.

(56) References Cited

U.S. PATENT DOCUMENTS

| | | | |
|---|---|---|---|
| 2,910,377 | A | 10/1959 | Owen |
| 3,028,255 | A | 4/1962 | Owen |
| 3,661,574 | A | 5/1972 | Bredoux et al. |
| 4,217,409 | A | 8/1980 | Inoue et al. |
| 4,237,212 | A | 12/1980 | Inoue et al. |

FOREIGN PATENT DOCUMENTS

| | | | |
|---|---|---|---|
| GB | 1 565 469 | A | 4/1980 |
| JP | 60 054888 | A | 3/1985 |
| JP | 05 221121 | A | 8/1993 |

*Primary Examiner*—Richard L. Schilling
(74) *Attorney, Agent, or Firm*—Saliwanchik, Lloyd & Saliwanchik

(57) ABSTRACT

A process for forming an image on a substrate, which comprises coating the substrate with an amine of molybdenum, tungsten or vanadium that changes colour on heating or irradiation as an aqueous dispersion or suspension or as a solution in an organic solvent. Also described is a coated substrate, wherein the coating is a substantially visible light-transparent layer comprising an amine compound of molybdenum, tungsten or vanadium, and a solution of said amine compound and a thermoplastic polymer or a photopolymerisable monomer.

28 Claims, No Drawings

USE OF TRANSITION METAL COMPOUNDS IN IMAGEABLE COATINGS

This application is a National Stage Application of International Application Number PCT/GB2003/004894, filed Nov. 12, 2003; which claims priority to Great Britain Application No. 0226383.8, filed Nov. 12, 2002 and Great Britain Application No. 0317860.5, filed Jul. 30, 2003.

FIELD OF THE INVENTION

This invention relates to transition metal compounds and their use in imageable coatings.

BACKGROUND OF THE INVENTION

For many years, heat-sensitive imaging sheets have been used for copying, thermal printing, thermal recording and thermal labelling. More recently, the development of scribing lasers has enabled the use of thermally-sensitive imaging materials for the coding and marking of both sheet materials and shaped objects that may or may not be self-supporting.

Two classes of colour-forming reactants have commonly been used for thermographic materials, i.e. leuco lactone or spiropyran compounds normally developed by phenolic compounds, e.g. as described in U.S. Pat. No. 3,846,153, and heavy metal salts of organic acids that can react with ligands to give coloured complexes, e.g. as described in U.S. Pat. No. 2,663,654. The use of both these types of compounds depends on effecting a physical separation of the solid components, through dispersing them in a polymer binder, coating them on a suitable support, and melting at least one of them to cause colour formation. When coated and dried, dispersions of solid materials, by their nature, result in layers of some opacity. This is normally acceptable on opaque substrates such as paper, but limits applications on transparent substrates such as clear Mylar (polyester) film and transparent packaging films. Examples of such applications are where a film transmission original is required or, in transparent film packaging applications, where film opacity would obscure sight of the packaging contents or container surface.

There is therefore a need for transparent, thermally-sensitive imaging layers for coating on transparent or semi-transparent film supports and reflective supports such as can-metal. Further, there is a need for transparent laser-sensitive imaging materials that may be coated or printed on shaped or formed objects such as bottles and other containers for labelling or coding applications. Naturally, for these applications, the coatings should adhere to the substrate firmly and be robust, i.e. have good resistance to the types of chemical and physical treatment encountered in the end use environment. In general, organic solvent-based compositions containing solvent-soluble binders give, on drying, tougher, better adhering layers of greater transparency and water-resistance than like water-based compositions.

The use of organic amine molybdates in thermal imaging layers is described in U.S. Pat. No. 2,910,377 (see Example 10) and U.S. Pat. No. 3,028,255 (where the exemplified amines are primary amines). This use is confined to copy paper sheets, and the molybdate is dispersed by prolonged ball-milling in a resinous binder to give a suspension, used for coating. Such a suspension, when coated and dried on a transparent film support, would cause loss of transparency.

U.S. Pat. No. 4,217,409 (see Examples 10 and 12) describes the use of isopropylammonium molybdate in an acidic aqueous solution of polyvinyl alcohol as a coating that, when applied to a substrate, gives a laminar material sensitive to electromagnetic radiation including IR, visible and UV radiation. Polyvinyl alcohol solutions often have poor coating properties towards polyester film and the hazy dried films detach readily. The dried and imaged coating would also be susceptible to physical and chemical damage, most notably chemical damage from water. Isopropylamine is volatile and would cause odour should the material be contacted with aqueous alkali.

U.S. Pat. No. 4,406,839 describes the synthesis of organic solvent-soluble amine molybdates useful as smoke retardants and made from a variety of amines. Examples employ high molecular weight amines such as tridodecylamine.

Amine molybdates, their synthesis and uses, are also described in U.S. Pat. No. 2,910,377, U.S. Pat. No. 3,028,255, U.S. Pat. No. 3,290,245, U.S. Pat. No. 4,053,455, U.S. Pat. No. 4,153,792, U.S. Pat. No. 4,217,292, U.S. Pat. No. 4,217,409, U.S. Pat. No. 4,226,987, U.S. Pat. No. 4,266,051, U.S. Pat. No. 4,406,837, U.S. Pat. No. 4,406,838, U.S. Pat. No. 4,406,839, U.S. Pat. No. 4,406,840, U.S. Pat. No. 4,410,462, U.S. Pat. No. 4,410,463, U.S. Pat. No. 4,424,164, U.S. Pat. No. 4,425,279, U.S. Pat. No. 6,217,797 and U.S. Pat. No. 6,355,277.

SUMMARY OF THE INVENTION

The present invention is based at least in part on the finding that amine molybdates and analogous compounds, some of which may be new, have properties that render them suitable for imaging. In particular, they are soluble in at least some organic solvents, are compatible with film-forming solvent-soluble organic binders, and give solutions that, when coated on an inert substrate such as clear polyester film and dried, form a continuous substantially visible light-transparent layer on the support. Such layers are thermally sensitive and find utility in thermographic materials for imaging by scanning laser or thermal printer, to provide effective marking, without opacification in the non-image areas.

According to one aspect of this invention, a process for forming an image on a substrate, comprises coating the substrate with a solution, in an organic solvent, of an amine compound of molybdenum, tungsten or vanadium, wherein the compound changes colour on heating or irradiation, and heating or irradiating the coating.

A further aspect of the invention is a coated substrate, wherein the amine is a secondary or tertiary alkylamine in which each alkyl group has up to 12 carbon atoms and the amine has up to 24 carbon atoms. Other aspects are solutions of the amine compound and a photopolymerisable monomer or a thermoplast.

The organic solvent solubility properties of the amine molybdates of the invention permit the avoidance of the time-consuming, wasteful and costly milling processes normally involved in the preparation of coating mixtures for known thermally sensitive imaging materials. They also allow thermally sensitive layers of good transparency and gloss to be made on transparent substrates such as Mylar and commercially available packaging films such as polypropylene.

DESCRIPTION OF PREFERRED EMBODIMENTS

Preferred compounds for use in the invention are amine molybdates. The term "amine molybdate" (of which an example is ethylamine molybdate) is used herein to describe compounds whose structure may be ill-defined, and which are also sometimes called the corresponding ammonium molybdates (e.g. ethylammonium molybdate), which implies that the compounds are salts. The generic term "amine molybdate" refers to complexes or salts formed on reacting an amine to give an amine molybdate or amine isopolymolybdate. For reference, see Cotton & Wilkinson; Advanced Inorganic Chemistry 2$^{nd}$ Edition 1967 Chapter 30 Section 30-C-2&3.

Amine molybdates will be described herein, for the purpose of illustration. Such compounds for use in the invention may be formed from amines and molybdate and polymolybdate (VI) acids and their salts and can be can be thermally activated in a coating, to give an image. Other compounds suitable for use in the invention, including those based on tungsten or vanadium, can be made in similar manner.

More specifically, such compounds are made, for example, using known saturated secondary or tertiary aliphatic dialkyl or trialkyl monoamines having boiling points (at 1 atmosphere pressure) equal to or above 150° C. and melting points below about 80° C., and with individual alkyl groups which are different or, preferably, the same, e.g. having from 3 to 12, preferably 5 to 12, more preferably 5 to 10, and most preferably 6 or 7 to 10 carbon atoms. Typically, the compound has a total of 7 to 24 C atoms. Salts of the compounds may also be used, such as amine acetates or chlorides. Representative amines are dipentylamine, tripentylamine, di-n-hexylamine, tri-n-hexylamine, bis(2-ethylhexyl)amine, di-n-octylamine and tri-n-octylamine. It will be understood that one or more amine compounds may be used.

The amine molybdates are made by reacting the amine with a molybdenum compound, e.g. in oxidation state VI, such as molybdenum trioxide, molybdic acid, ammonium dimolybdate, ammonium heptamolybdate, ammonium octamolybdate, sodium molybdate or commercial "molybdic acid" (which comprises primarily one or more ammonium molybdates). A representative and preferred amine molybdate for use in the invention is bis(2-ethylhexyl)amine octamolybdate.

Amine molybdates suitable for use in the invention have one or more of the following properties:

(i) Individually soluble in at least one organic solvent (ii) Transparent or near transparent film-forming properties on specified commercial polymer substrates when applied by coating or printing an organic solvent solution (iii) Thermal sensitivity manifested as a colour change of good visual discrimination when a layer comprising the amine molybdate is exposed thermally imagewise by a scanning laser and/or heat block imaged by a thermal printer (iv) Compatibility with at least one solvent-soluble binder polymer as indicated by the formation of a near transparent film of a blend (v) Preparation using an amine precursor of low volatility, so that there is low risk of a hazard if the amine molybdate layer is exposed to aqueous alkali and the amine is released The amine molybdates are soluble in organic solvents, are compatible with film-forming solvent soluble organic binders, and give solutions that, when coated or printed on an inert substrate such as clear Mylar polyester film and dried, form a continuous layer of the amine molybdate that is substantially transparent to visible light. Such layers are thermally sensitive and find utility in thermographic materials and on 3D objects for imaging by scanning laser or thermal printer. Clear layers formed by means of the invention may also be useful on opaque substrates because they can impart desirable gloss, as distinct from compositions containing suspended insoluble molybdates that give matt surfaces.

Imaging elements comprising these amine molybdates may be supported on a flexible sheet substrate, preferably a flexible transparent sheet substrate such as polyester. Alternatively a rigid 3D object substrate may be used such as the external surface of a container. There should be a good adhesive bond between imaging element and substrate. The substrate should be able to withstand laser imaging of the element (comprising the amine molybdate) without unacceptable degradation or deformation upon laser or thermal imaging. Preferred substrates are transparent or translucent materials that absorb the IR radiation output of the laser to some extent: otherwise the substrate may act as a heat sink to the laser-exposed areas of the imaging element, reducing layer sensitivity. In this respect Mylar polyester film is better than unfilled polypropylene or polyethylene.

The solvent-soluble molybdates used in the invention can be applied from solution and dried to give a near-transparent layer. Film-forming compositions containing these amine molybdates give layers having good adhesion transparency and imagewise thermal sensitivity. Such layers can have filmogenic and transparency properties, e.g. on commercial transparent polymer film supports such as clear polypropylene, providing near-transparent, thermally sensitive sheet or web materials. The solvent-soluble amine molybdates also show good compatibility when blended with specified organic solvent-soluble polymeric binders; these blends can also form useful substantially transparent thermally sensitive layers, to provide thermographic materials.

The invention also provides amine molybdate compositions that, when applied as a solvent coating to commercially available transparent film or supports or otherwise incorporated on or within transparent or semi transparent polymer layers, give direct thermally sensitive imaging media having excellent stability transparency and sensitivity properties for thermal laser imaging or, if appropriate, thermal printing. The coating weight of the dry coating is normally in the range 0.5 to 20 g/m$^2$, preferably 1 to 10 g/m$^2$.

The invention also provides thermally sensitive imaging materials comprising a layer comprising the amine molybdate, adhering to a substrate or within a substrate which is preferably an optically near transparent or translucent polymeric material. Suitable substrates include paper, laminates and films of the type described above. Another aspect of this invention is thermally imageable materials comprising the amine molybdate and incorporated on a substrate.

Amine molybdates may also be useful in dispersed form in a thermographic layer. Some are readily dispersed in water, and may be used, say, on an opaque substrate like paper to give a matt layer. Thus, depending on the conditions, the amine molybdates may be used for both transparent/glossy materials and also opaque/matt materials.

Thermally imageable materials comprising an amine molybdate in solid solution or dispersion in a molten material comprising a thermoplastic polymer, may be made by cooling the material whilst rolling it flat or forming it into a shape, such as the shape of a container.

Thermally imageable materials comprising an amine molybdate in solution or dispersion in a liquid photopolymerisable composition may be made by photopolymerising the composition.

It will be appreciated by one of ordinary skill in the art that it is possible to incorporate additives of various sorts in the imaging layers, and which might be beneficial in certain circumstances. Such additives include, for example, polymer binders, mild reducing agents to promote thermal printer performance, colorants such as dyes or pigments, antioxidants and other known stabilisers, antiblocking materials such as talc or selected silicas, and materials adsorbent to or reactive with any thermolysis products of laser imaging.

An additive of particular utility, in solution or suspension or in a separate layer, is an electron-donating dye precursor often known as a colour-former. When amine molybdates are incorporated in a layer with such colour-formers and thermally imaged, e.g. using a $CO_2$ laser, coloured images may be obtained. The colour may correspond to that obtained by the use of common colour developers such as certain phenols. Weak block images may also be obtained, e.g. using a heat sealer at 100-120 C and contact times of 1-10 seconds. Thus the amine molybdate acts as an electron acceptor and colour developer for at least some of these colour-formers. The low melting point of amine molybdates means that they can be fused with colour-formers, if desired.

Protective polymer or other layers on the imaging layer may be useful in some circumstances. For example, such layers may prevent or reduce mechanical or chemical damage to the unexposed or exposed thermally sensitive layers of the invention. Layers comprising mild reducing agents may also be added to promote thermal printer performance. Such layers may also act to reduce emanation of any thermolysis products of laser imaging. Such layers can be applied by known means such as lamination or coating.

As indicated above, an image can be formed by the application of heat. Preferably, heat is applied locally, on irradiation with a laser. Suitable lasers include those emitting at high energy, including Nd-YAG lasers and $CO_2$ lasers, the latter typically at a wavelength of 10,600 nm. In many cases, it may be desirable to use a low-energy laser, such as a diode laser, typically emitting light at a wavelength in the range of 800-1500 nm. In certain circumstances, this energy input may be insufficient to cause the desired reaction, and the composition to be irradiated then preferably comprises a suitable absorbent material.

IR-absorbent materials are known. In general terms, any suitable such material may be incorporated, for the purposes of this invention, and can be chosen by one of ordinary skill in the art. A particularly preferred IR absorber for use in the invention is a conducting polymer, by which is meant a material that, in the polymerised state, comprises linked monomers (typically rings) that are conjugated and which can therefore allow delocalisation/conduction of positive or negative charge. The conjugation allows an absorption shift that can be controlled such that it applies to the wavelength of irradiation, and which may also depend on the concentration of the polymer.

Examples of monomers that can be conjugated to give suitable conducting polymers are aniline, thiophene, pyrrole, furan and substituted derivatives thereof. Such polymers, in addition to providing the desired means of transferring heat from a low-power laser, have the advantage that they do not readily diffuse out of the coating material. They can also act as the polymer binder. Yet another advantage of such materials is that they can be colourless, even at high loading (up to 5% by weight); this is by contrast to monomeric species that have been used, such as phthylocyanine, which absorb at about 800 nm but give the composition a greenish tinge, even at a loading of 0.1% by weight.

Depending on the components to be irradiated, a black or coloured image may be obtained. The colour may be dependent on the irradiation power; thus, for example, a blue colour may be overpowered to black.

Multi-colour printing may also be achieved, e.g. using different colour-formers (and, if necessary, absorbers) responsive to different irradiation wavelengths. For example, UV, diode and $CO_2$ lasers may be used to give three-colour printing, by providing appropriate, different colour formers at different/overlapping locations on the substrate.

The initial colour of coating and image achieved on activation is not limited. Theoretically, any initial or final colour (red, blue, green, etc) is achievable and the energy required to develop the image (e.g. 100-140° C./2-4 Watts) can be controlled within a range. Additionally, a step-change of the image colour produced can be controlled with activation (e.g. 150-200° C./3-5 Watts), and so more than one distinct colour is possible from the same coating.

In general, the colour developer can be one or more of a range of water-compatible transition metal complex materials as an amine molybdate.

The colour former can be one or more of a range of established basic dyes such as fluorans, phthalides etc.

The binder can be one or more of a range of water-soluble or amine-stabilised emulsion polymers, for a water-borne dispersion ink, or a solvent-soluble polymer for a solvent-borne dispersion or solution ink. Acrylic polymers can be used in each case.

Pigments can be water-dispersible inorganic or organic additives such as calcium carbonate etc.

One or more of a range of additives can be utilised, including surfactants or lubricants such as zinc stearate etc.

The IR-sensitive coating can be applied by a range of methods such as flood coating, flexo/gravure etc.

The IR-sensitive coating can be applied to a range of substrates such as self-adhesive label etc.

A protective layer of a film-forming water-borne top-coat ink can be applied onto the IR-sensitive coating.

The IR-absorber can be one or more of a range of water-compatible organic or inorganic materials, for a water-borne dispersion ink, or a solvent-compatible, organic or inorganic material for a solvent-borne dispersion or solution ink (in the latter case, the material is preferably solvent-soluble).

The following Examples illustrate the invention.

EXAMPLE 1

Bis(2-ethylhexyl)amine octamolybdate

The following synthesis is adapted from the method given in U.S. Pat. No. 4,217,292 (Example 3) for dodecylammonium octamolybdate.

In a 500 ml flange flask vessel were weighed molybdenum trioxide (15.53 g; Aldrich 99%; 10-20 μm particle size by Fisher sub-sieve sizer), deionised water (300 g) and ammonium chloride (8.6 g) (Aldrich reagent). The mixture was stirred vigorously while bis(2-ethylhexyl) amine (13.03 g; Aldrich) was added dropwise over 10 minutes. The vessel contents were then heated to reflux with stirring and refluxed for 4 hrs. A pale green-blue tarry material formed that part adhered to the vessel walls. On cooling, the reaction mixture to room temperature, the tarry product formed a glass-like solid. The solid was collected by filtration with some manipulative loss, ground and washed successively with deionised water and finally with isopropanol. Finally the pale green-blue product was dried in an oven for 24 hrs at 65° C. Yield was 26.2 g. It was readily soluble in 2-butanone to give a pale-green solution. A trace of white material (perhaps unreacted $MoO_3$) remained undissolved.

EXAMPLE 2

Coating Composition without Polymer Binder

Bis(2-ethylhexyl)amine octamolybdate (10 g) was dissolved in 2-butanone (30 g). The solution was separated from a trace of insoluble white solid impurity to give a solution that can be used as a coating composition of the invention.

EXAMPLE 3

Thermally Imageable Material

The solution prepared in Example 2 was coated on each of four supports, i.e. opaque white (titanium dioxide-filled) Mylar film, clear Mylar (polyethylene terephthalate) film, domestic aluminium foil, and polypropylene packaging film (UCB). This was done using a wire coating bar, giving a 12 μm on wet film, and dried using warm air to give a thermally imageable material.

Continuous glossy well-bonded films were obtained in each case. The coatings on clear Mylar and polypropylene were transparent and all were non-tacky when cool. The dry coating weights were found to be about 3 $g/m^2$. The resulting coated materials were exposed imagewise using a $CO_2$ scribing laser beam of 0.3 mm diameter at a scan speed of 1000 mm/sec. A distinct grey-black image of alphanumeric characters was obtained when the power was set at 3-4 Watts for Mylar and aluminium foil substrates. The images were less legible at 2 Watts, indicating sub-optimum exposure. With the polypropylene substrate, images were obtained at about 6 W.

EXAMPLE 4

Coating Composition Containing Polymer Binder

A solution of bis(2-ethylhexyl)amine octamolybdate (10 g) was dissolved in 2-butanone (30 g). The solution was separated from a trace of insoluble white solid impurity. 4 g of this solution was mixed with 4 g of a 15% by weight solution of Elvacite 2041 (a methyl methacrylate homopolymer resin grade manufactured by INEOS) binder in 2-butanone to give a coating solution.

EXAMPLE 5

Thermally Imageable Film

The solution of Example 4 was coated on packaging grade polypropylene film using a wire-wound bar (giving a nominal 12 μm wet film thickness) and dried using warm air to give a transparent coated film. The transparency observed indicates good compatibility of the amine molybdate and the acrylic binder. The dry coating weight was found to be 2.8 $g/m^2$. The resulting coated film of the invention had high transparency. It was exposed imagewise using a $CO_2$ scribing laser beam of 0.3 mm diameter at a scan speed of 1000 mm/sec. A distinct grey-black image of alphanumeric characters was obtained when the power was set at 3-4 Watts. Some lifting of the image was observed at 4 Watts. The image was less legible at 2 Watts, indicating inadequate exposure.

EXAMPLE 6

Red Thermographic Film

To 0.4 g of a 25% by weight solution of bis(2-ethylhexylamine) octamolybdate in 2-butanone was added with thorough mixing 1.0 g of a 33.3% by weight solution of Elvacite 2044 also in 2-butanone (Elvacite 2044 is a n-butyl methacrylate-based acrylic resin manufactured by INEOS Acrylics). In this composition was dissolved by agitation 0.1 g of a commercial electron-donating colour-former (Pergascript Red I-6B manufactured by Ciba Specialty Chemicals and described as a bisindolyl phthalide compound). The resulting pale yellowish-pink solution was coated on clear Mylar film using a 25 wire bar and dried using warm air. A transparent film resulted.

A pale red image resulted on block imaging the film at 100° C. using a heat sealer and a contact time of 10 seconds. A distinct red image resulted from imaging the film using a $CO_2$ scribing laser beam of 0.3 mm diameter at a scan speed of 1000 mm/second and set at 3 Watts power.

EXAMPLE 7

Water-borne Dispersion Inks

The effect of the presence of an IR absorber in an ink formulation of the invention was determined. Blue and red water-based acrylic-emulsion inks of PVOH-stabilised dispersion (comprising PBI2RN or PRI6B colour former) were assessed.

A "standard" formulation of the invention was used, comprising the following proportions of components (% w/w):

| | |
|---|---|
| Binder | 16.0 |
| Active Pigment | 7.0 |
| Colour Former | 7.0 |
| Fluid | 70.0 |

Various "active" formulations were used, each containing the IR absorber Baytron P (HC Starck), a conducting polymer. The proportions of IR absorber used were 1.0, 2.5 and 5.0% (w/w). In, for example, formulations comprising 5.0% Baytron P, the composition was:

| | |
|---|---|
| Binder | 15.2 |
| Active Pigment | 6.7 |
| Colour Former | 6.7 |
| Fluid | 64.4 |
| IR Absorber | 5.0 |

The components were selected from:

| | |
|---|---|
| Binder | Gohsenol GH-17 polyvinyl alcohol and Texicryl acrylic emulsion; |
| Active Pigment | Bis(2-ethylhexylamine)octamolybdate and di(cyclohexylamine)octamolybdate |
| Colour Former | Pergascript blue I-2RN crystal violet lactone and red I-6B; |
| Fluid | water, dilute ammonium hydroxide etc; and |
| IR Absorber | Baytron P |

A 940 nm Rofin Dilas DF060 Diode Laser and K-bar 2.5-coated substrates were used for image forming.

The results are shown in Table 1. A good image was obtained when Baytron P was present.

TABLE 1

| Ink Type | IR Absorber | Level (% w/w) | Unimaged | Imaged (940 nm) |
|---|---|---|---|---|
| Standard, blue | — | n/a | Off-white (slight) | No image |
| " | — | n/a | " | " |
| Active, blue | Baytron P | 1.0 | " | " |
| " | " | 1.0 | " | Blue Image |
| " | " | 2.5 | " | " |
| " | " | 2.5 | " | " |
| " | " | 5.0 | " | " |
| " | " | 5.0 | " | " |
| Standard, red | — | n/a | White | No image |
| " | — | n/a | " | " |
| Active, red | Baytron P | 1.0 | Off-white (slight) | Red Image |
| " | " | 1.0 | " | " |
| " | " | 2.5 | " | " |
| " | " | 2.5 | " | " |
| " | " | 5.0 | " | " |
| " | " | 5.0 | " | " |

Samples of the blue ink formulations were coated with K-bar 2.5 onto Rafaltac Raflacoat (RC) and Hi-Fi polyester (PE) substrates. The coated substrates were then used for Nd:YAG (1064 nm) laser text imaging. Two formulations comprised Baytron P, two did not. The results are shown in Table 2.

TABLE 2

| Ink Type | IR Absorber at 5.0% (w/w) | Substrate | Unimaged | Imaged (1064 nm) |
|---|---|---|---|---|
| Standard, blue | — | RC | White | No Image |
| Active, blue | Baytron P | RC | Off-White (grey) | Blue Text |
| Standard, blue | — | PE | White | No Image |
| Active, blue | Baytron P | PE | Off-White (grey) | Blue Text |

The coatings in which Baytron P was absent gave no image or very faint text. PE-based samples gave better results than RC-based ones. Where images were obtained (i.e. when Baytron P was present), they were sharp and well-defined.

EXAMPLE 8

Solvent-borne Dispersion Inks

Experiments similar to those of Example 7 were performed except that solvent-based inks were used.

The "standard" formulation was composed of (% w/w):

| | |
|---|---|
| Binder | 21.7 |
| Active Pigment | 9.6 |
| Colour Former | 9.6 |
| Fluid | 59.1 |

The "active" formulations contained the IR absorber Iriodin LS820 (Merck). The composition of the 5% (w/w) "active" formulation was:

| | |
|---|---|
| Binder | 19.5 |
| Active Pigment | 8.6 |
| Colour Former | 8.6 |
| Fluid | 53.3 |
| IR Absorber | 10.0 |

The results are shown in Table 3. Again, the presence of an IR absorber allowed image formation to occur.

TABLE 3

| Ink Type | Additive Type | Level % w/w | Unimaged | Imaged (940 nm) |
|---|---|---|---|---|
| Standard, blue | — | n/a | Off-white (slight green) | No image |
| " | — | n/a | " | " |
| " | — | n/a | " | " |
| Active, blue | Iriodin LS820 | 5.0 | Off-white (grey/green) | Blue Image |
| " | Iriodin LS820 | 5.0 | " | " |
| " | Iriodin LS820 | 5.0 | " | " |
| " | Iriodin LS820 | 10.0 | " | " |
| " | Iriodin LS820 | 10.0 | " | " |
| " | Iriodin LS820 | 10.0 | " | " |
| Standard, red | — | n/a | Off-white (pink) | No image |
| " | — | n/a | " | " |
| " | — | n/a | " | " |
| Active, red | Iriodin LS820 | 5.0 | Off-white (grey/pink) | Red Image |
| " | Iriodin LS820 | 5.0 | " | " |
| " | Iriodin LS820 | 10.0 | " | " |
| " | Iriodin LS820 | 10.0 | " | " |
| " | Iriodin LS820 | 10.0 | " | " |
| " | Iriodin LS820 | 10.0 | " | " |

EXAMPLE 9

Solvent-borne Solution Inks

Experiments similar to those of Examples 7 and 8 were performed except that solvent-based inks in acrylic methyl ethyl ketone (MEK) solution were assessed.

The ink formulations comprised 0.1% (w/w) Pro-Jet 900NP (Avecia), an IR absorber. Some formulations additionally comprised a UV absorber. In some cases, colour former (CF) was present at a ratio of 1:1 or 1:2 with the active pigment (CD). A typical formulation was composed of (% w/w):

| | |
|---|---|
| Binder | 23.7 |
| Active Pigment | 4.6 |
| Colour Former | 4.6 |
| UV Absorber | 6.7 |
| Fluid | 60.3 |
| IR Absorber | 0.1 |

The results are shown in Table 4. Generally, good images was obtained.

TABLE 4

| Ink Type | Unimaged | Imaged (940 nm) |
|---|---|---|
| no CF | Clear (green) | Dark Image |
| " | " | " |
| " | " | Incomplete |
| Blue, CD:CF = 1:1 | Clear (grey/green) | Dark Image |
| " | " | " |
| " | " | Incomplete |
| Blue, CD:CF = 1:2 | " | Dark Image |
| " | " | " |
| " | " | Incomplete |
| Red, CD:CF = 1:1 | Clear (grey/brown) | Dark Image |
| " | Clear (green/grey) | " |
| " | " | Incomplete |
| Red, CD:CF = 1:1 | Clear (pink/brown) | Dark Image |
| " | Clear (brown/grey) | " |
| " | " | Incomplete |

The invention claimed is:

1. A method for forming an image on a substrate, which comprises coating the substrate with a substantially visible light-transparent solution, in an organic solvent, of an amine compound of molybdenum, tungsten or vanadium that changes colour on heating or irradiation, and heating or irradiating the coating, wherein the amino is a secondary or tertiary alkylamine in which each alkyl group has up to 12 carbon atoms and the amine has up to 24 carbon atom, wherein the amine is of molybdenum (VI).

2. A method for forming an image on a substrate, which comprises coating the substrate with a substantially visible light-transparent aqueous dispersion or suspension, of an amine compound of molybdenum, tungsten or vanadium that changes colour on heating or irradiation, and heating or irradiating the coating, wherein the amine is a secondary or tertiary alkylamine in which each alkyl group has up to 12 carbon atoms, and the amine has up to 24 carbon atoms wherein the amine compound is of molybdenum (VI).

3. The method according to claim 1, wherein the coating also comprises the use of an organic polymer binder.

4. Time method according to claim 1, wherein the coating also comprises the use of a colour-former.

5. The method according to claim 1 wherein the substrate is substantially transparent to visible light.

6. The method according to claim 1, wherein the coating additionally comprising IR absorber that absorbs laser radiation.

7. A coated substrate, wherein the coating is a substantially visible light-transparent layer comprising an amine compound of molybdenum, tungsten or vanadium that changes colour on heating or irradiation, wherein the amine is a secondary or tertiary alkylamine in which each alkyl group has up to 12 carbon atoms and the amine has up to 24 carbon atoms, and wherein the substrate is also substantially transparent to visible light, wherein the amine compound is of molybdenum (VI).

8. The coated substrate according to claim 7, wherein the coating also comprises arm organic polymer binder.

9. The coated substrate according to claim 7, wherein the substrate is also substantially transparent to visible light.

10. The coated substrate according to claim 7, including also an image formed therein by heating or irradiation.

11. The coated substrate according to claim 7, wherein the coating additionally comprises aim IR absorber that absorbs laser radiation.

12. A solution of an amine compound of molybdenum, tungsten or vanadium that changes colour on heating or irradiation and one of the following:

a thermoplastic polymer;

or a photopolymerisable monomer, and wherein the amine is a secondary or tertiary alkylamine in which each alkyl group has up to 12 carbon atoms and the amine has up to 24 carbon atoms, wherein the amine compound is of molybdenum (VI).

13. The solution according to claim 12, which is fluid at or below 150° C.

14. The method according to claim 2, wherein the coating also comprises the use of an organic polymer binder.

15. The method according to claim 2, wherein the coating also comprises the use of a colour-former.

16. The method according to claim 2, wherein the substrate is substantially transparent to visible light.

17. The method according to claim 2, wherein the coating additionally comprises an IR absorber that absorbs laser radiation.

18. The coated substrate according to claim 7, wherein the coating also comprises the use of a colour-former.

19. A method for forming an image on a substrate, which comprises coating the substrate with a substantially visible light-transparent solution, in an organic solvent, of an amine compound of molybdenum, tungsten or vanadium that changes colour on heating or irradiation, and heating or irradiating the coating, wherein the amine is a secondary or tertiary alkylamine in which each alkyl group has up to 12 carbon atoms and the amine has up to 24 carbon atoms, wherein the coating is irradiated using a laser, and wherein the laser light has a wavelength of 800-1500 nm.

20. The method according to claim 19, wherein the coating also comprises the use of an organic polymer binder.

21. The method according to claim 19, wherein the coating also comprises the use of a colour-former.

22. The method according to claim 19, wherein the substrate is substantially transparent to visible light.

23. The method according to claim 19, wherein the coating additionally comprises an IR absorber that absorbs laser radiation.

24. A method for forming an image on a substrate, which comprises coating the substrate with a substantially visible light-transparent aqueous dispersion or suspension, of an amine compound of molybdenum, tungsten or vanadium that changes colour on heating or irradiation, and heating or irradiating the coating, wherein the amine is a secondary or tertiary alkylamine in which each alkyl group has up to 12 carbon atoms and the amine has up to 24 carbon atoms, wherein the coating is irradiated using a laser, and wherein the laser light has a wavelength of 800-1500 nm.

25. The method according to claim 24, wherein the coating also comprises the use of an organic polymer binder.

26. The method according to claim 24, wherein the coating also comprises the use of a colour-former.

27. The method according to claim 24, wherein the substrate is substantially transparent to visible light.

28. The method according to claim 24, wherein the coating additionally comprises an IR absorber, that absorbs laser radiation.

* * * * *

UNITED STATES PATENT AND TRADEMARK OFFICE

CERTIFICATE OF CORRECTION

PATENT NO. : 7,270,919 B2
APPLICATION NO. : 10/533526
DATED : September 18, 2007
INVENTOR(S) : Brian Stubbs It is certified that error appears in the above-identified patent and that said Letters Patent is hereby corrected as shown below:

Column 11,
Line 28, “amine is” should read --amine compound is--.

Column 11,
Line 40, “Time method” should read --The method--.

Column 11,
Line 45, “comprising” should read --comprises an--.

Column 11,
Line 57, “comprises arm” should read --comprises an--.

Column 11,
Line 63, “comprises aim” should read --comprises an--.

Signed and Sealed this

Twenty-ninth Day of April, 2008

JON W. DUDAS
*Director of the United States Patent and Trademark Office*